US006045639A

United States Patent [19]

Davis

[11] Patent Number: 6,045,639

[45] Date of Patent: Apr. 4, 2000

[54] APPARATUS AND METHOD FOR CREATING WALL MURALS AND THE LIKE

[76] Inventor: Debra K. Davis, 1604 Cherbourg, Plano, Tex. 75075

[21] Appl. No.: 09/221,505

[22] Filed: Dec. 28, 1998

Related U.S. Application Data

[63] Continuation of application No. 08/567,935, Dec. 6, 1995, abandoned.

[51] Int. Cl.[7] ..... B44C 1/16

[52] U.S. Cl. ..... 156/62; 156/71; 156/234; 156/235; 156/240; 434/88

[58] Field of Search ..... 156/62, 63, 71, 156/234, 235, 239, 240, 248, 249, 289; 33/565; 40/584, 595; 434/88; 462/69

[56] References Cited

U.S. PATENT DOCUMENTS

| | | | |
|---|---|---|---|
| 3,440,746 | 4/1969 | Richards | 40/595 |
| 3,492,743 | 2/1970 | Schmidt | 434/88 |
| 3,761,344 | 9/1973 | Mrozek et al. | 40/595 X |
| 3,785,912 | 1/1974 | Van Duesen | 156/240 X |
| 4,053,660 | 10/1977 | Hurwitz et al. | 427/153 |
| 4,148,057 | 4/1979 | Jesse | 347/248 X |
| 4,200,675 | 4/1980 | Flor et al. | 462/69 X |
| 4,900,392 | 2/1990 | Bradshaw et al. | 156/235 X |
| 5,016,452 | 5/1991 | Alexander | 434/88 X |
| 5,110,295 | 5/1992 | Concra | 434/88 |
| 5,324,378 | 6/1994 | Sieber | 156/235 X |
| 5,372,506 | 12/1994 | Hambright | 434/88 X |
| 5,439,538 | 8/1995 | Perry | 156/63 |

FOREIGN PATENT DOCUMENTS

| | | | |
|---|---|---|---|
| 962138 | 2/1975 | Canada | 156/240 |

OTHER PUBLICATIONS

Magic Mural Packaging and Instructions, Blazing Kancepts, Dallas, Texas, 1994.

Classic Dimensions Packaging and Instructions, American Traditional, 1995.

Shaw, Jackie; The Big Book of Decorative Painting; pp. 297–300; Watson–Guptill Publications;New York City, USA, Nov. 1994.

Seligman, Patricia; Painting Murals; pp. 49–50; North Lights Books; Cincinnati; OH, USA, Sep. 1989.

*Primary Examiner*—Mark A. Osele
*Attorney, Agent, or Firm*—Patnaude & Videbeck

[57] ABSTRACT

Apparatus and method for creating graphic compositions such as murals by transferring selected portions of the mural from tracing sheets using a wand or stylus to trace the outlines of the individual objects and certain shaded areas of the objects onto a surface such as a wall to create a three-dimensional effect. An alignment scale is provided to align each of the transfer sheets so that the sheet may be removed after selected objects have been transferred to the surface and thereafter reapplied to transfer additional objects to the surface in registry with the first set of objects. Guide numbers or printed symbols are provided to direct the user to apply the appropriate colors and shades of colors to each of the areas on the transferred graphic or mural. The transfer wand includes both a pinwheel and a stylus on a single instrument for creating thick, thin or dashed lines, or solidly-shaded areas together with an eraser to be used to correct or redo transfer lines. Additional objects are added by attaching graphics of these objects to the transfer sheet and tracing the additional objects.

9 Claims, 4 Drawing Sheets

APPARATUS AND METHOD FOR CREATING WALL MURALS AND THE LIKE

This application is a continuation of application Ser. No. 08/567,935 filed on Dec. 6, 1995, now abandoned.

FIELD OF THE INVENTION

The present invention relates to methods for transferring graphics from a set of master sheets to a flat surface and painting or coloring the graphics so transferred to create a mural, applique, or the like and kits comprising the apparatus needed to carry out the methods.

BACKGROUND OF THE INVENTION

Hand-painted designs such as murals and rosemaling have long been used to decorate wall and ceiling surface, furniture, and the like. Typically, such designs had to be drawn and painted by artists in order to create a professional, three-dimensional, well-finished appearance. Those less talented decorators who wanted a professional-appearing result have in the past used such techniques as taking pre-printed wall graphics and applying them to walls in much the same manner as wall paper or using stencil kits to roll on decorative strips or borders. Creating the appearance of a lifelike, realistic, professional, three-dimensional hand-painted decoration is difficult, however, and is not accomplished by either of these two foregoing methods.

A familiar type of hand-painted art is the paint-by-numbers kit, usually consisting of a cardboard or other flat panel upon which a design is printed, with each of the enclosed areas of the design identified with a number. These numbers correspond to different colors of paints and the "artist" can complete a picture by filling in each of the designated areas with the color identified in the area. This type of design does not produce a realistic effect. Colors are not blended together but are applied in discrete patches, which border on each other and do not blend in with each other. When a paint-by-number graphic is viewed up close, it has the appearance of a collection of separate patches of paint rather than a blended, coherent artistic effect.

Attempts have been made to adapt the paint-by-number technique to creating murals.

U.S. Pat. No. 4,696,400 (Warman) teaches and describes a kit for creating murals consisting of a slide projector, a slide transparency of a graphic design with different areas of the design identified by numbers, a collection of paint pots numbered to correspond with the numbers on the transparency, and a number of brushes to be used for applying the paint. In use, the transparency is projected on the wall to be decorated and copied by following the outlines of the transparency with pencils so that a pencilled design remains on the wall. Thereafter, the individual areas are painted in accordance with the numbers identified in the different areas of the transparency.

It can be readily appreciated that such a technique brings with it the same non-satisfying results as the paint-by-numbers kits, namely, the creating of contiguous patches of flat-looking color as opposed to the blending and overlapping of colors and brush strokes present in conventionally painted scenes.

U.S. Pat. No. 3,372,493 (Birch) teaches and describes an antiqued painting on wood and by-the-number system of making the same which deliberately takes advantage of the effect created by discrete adjoining patches of color by using outlined, discrete areas to simulate primitive, antique paintings on wood. The '493 patent utilizes outlined drawings with the individual segments to be colored outlined on oleophobic ink to insure that any paint overlapping onto the lines will not stick to the lines but will be instead confined to the spaces delineated by the lines. The '493 patentee implicitly acknowledges that the paint-by-numbers is useful to produce, at best, a rather primitive painting effect.

A number of patents disclose paint-by-number techniques, apparatus and kits.

U.S. Pat. No. 2,712,189 (Grossman) teaches and describes a painting kit for paint-by-numbers art with paints packaged in individual capsules and with a part of the packaging used to hold the capsules.

U.S. Pat. No. 2,744,349 (Grossman) teaches and describes a method of painting in the reproduction of paintings as a paint-by-numbers kit using lecithin-based paints.

U.S. Pat. No. 2,825,150 (Steiner) teaches and describes the production of water color pictures which adapts the medium of water colors to paint-by-numbers by providing drawings with numbered areas and water color pens used to fill in the spaces. to U.S. Pat. No. 2,954,615 (Brown) teaches and describes an art painting kit which utilizes a transparent sheet with a paint-by-numbers design printed on one side with erasable lines. Paint is then applied to the other side and, after the paint has dried, the lines are erased, leaving only the painted surface.

U.S. Pat. No. 4,416,632 (Berman) teaches and describes a paint-by-numbers kit which further adapts the use of water colors to paint-by-numbers art by printing the numbers in water-soluble ink so that the numbers disappear as the water colors are applied.

U.S. Pat. No. 841,360 (Tuck) teaches and describes a combined painting book and color box which is a kit in which the pictures to be painted are kept in a book along with the paints to be used.

Another shortcoming of prior known mural transfer techniques and kits is the fact that the pattern to be transferred must be transferred exactly as drawn with no provision for changing or rearranging elements within the mural or graphic. Prior attempts to add successive, multiple elements to drawings do not achieve the effect of the present invention.

U.S. Pat. No. 3,447,250 (Van Savage) teaches and describes a painting guide kit using multiple sheets placed successively under a transparent sheet and copied or painted onto the upper surface of the sheet.

There is also known a dressmakers' technique for transferring patterns to cloth by using clothing patterns printed on carbonless "tracing paper" by printing the pattern on one or more sheets of tracing paper which, when traced with a tracing wheel or a stylus leaves a line or track on the cloth over which the tracing paper is placed. The paper itself, and the "star wheel" tool used to track designs on the paper are well known to dress makers: such star wheels and tracing paper are sold, for example, by the Dritz Company and are typical examples. There is no provision in these techniques for using less than an entire pattern or for making changes in the designs presented.

U.S. Pat. No. 235,898 (Rogers) teaches and describes a stylus for writing on manifold paper which is a tool with a solid metal stylus used for writing on "manifold" paper (carbon paper).

U.S. Pat. No. 3,707,098 (Kern) teaches and describes a transfer tool having a PTFE tip to eliminate friction between the tip and the transfer paper.

U.S. Pat. No. 3,760,660 (Van Arnam, et al.) teaches and describes a burnishing tool having a tip mounted to a spring-loaded plunger which applies a constant force to the surface of a carrier sheet during tracing.

U.S. Pat. 3,494,040 (Goodwin) teaches and describes a sewer's marking tool having five arms, one of which has a star wheel marker, while the remaining four arms are each formed in the shape of a common dressmaker's symbol and may be used to transfer those symbols from a pattern to cloth.

U.S. Pat. Des. No. 199,564 (Koss) teaches and describes a combined seam ripper and tweezers, an example of a sewer's accessory combining more than one function on a single tools.

Techniques for transferring graphic designs to flat workpieces are also found in the prior art. U.S. Pat. No. 5,226,990 (Satomi) teaches and describes a method for transferring a rough design to a textile or leather substrate by overlaying the design to be copied with an ink-permeable sheet, tracing the design onto the sheet with a writing implement, placing the sheet over a leather or textile substrate and retracing the design with a writing implement, enabling the ink to permeate the sheet and leave a copy of the design on the substrate.

U.S. Pat. No. 5,016,452 (Alexander) teaches and describes a method for transferring a color photograph to a leather surface by xerographically copying the photograph, overlaying the leather with the copy and using leatherworking tools to outline the copy and, thereby, cut and raise the surface of the leather to reproduce the photo. The leather is then dyed or colored to produce a colored-in version of the photograph.

U.S. Pat. No. 3,364,598 (Cook) teaches and describes the creation of composite pictures by tracing portions of a master picture onto colored cloth sheets in accordance with numbers on the original and thereafter cutting out the individual picture elements and gluing them onto a backing sheet to produce a finished graphic.

U.S. Pat. No. 1,289,342 (Witte) teaches and describes a device for transferring outlines or drawings in color which involves the tracing of an illustration to produce a colored copy by successively tracing portions of the illustration through colored carbon paper sheets.

U.S. Pat. No. 2,071,441 (Varren) teaches and describes the use of a transparent manifolding pattern sheet with a backing having a design and colored carbon impressions outlining the design elements. Use of a pencil or tracing tool applied to the front of the sheet transfers a colored outline version of the design to a blank sheet placed under the transfer sheet.

U.S. Pat. No. 4,559,732 (Levy, et al.) teaches and describes a method of applying signs to glass by placing a film of material, bearing the desired design, on the outside of the glass and placing a translucent sheet on the inside of the glass in registration with the film and, thereafter, cutting away portions of the sheet corresponding to the design and removing the film.

U.S. Pat. No. 5,372,506 (Hambright) teaches and describes a draw-through pattern graphics system for applying graphics to clothing items. A bracket is used to hold a portion of the clothing against a backing board while, at the same time, holding a screen pattern in register with the bracket. Inks are then applied to the screen pattern in various colors, and the pattern can be removed from the bracket to check the progress of the transfer.

U.S. Pat. No. 1,535,242 (Parmenter) teaches and describes a tracing and printing device having a holder within which a graphic to be traced is placed. A clear sheet is also placed within the holder and the graphic is traced onto the sheet.

U.S. Pat. No. 4,328,051 (Robinette) teaches and describes a system for transferring images in which a first tracing is made onto a transparent sheet and thereafter is transferred to a net-like material. Thereafter, the design is transferred to a fabric substrate by tracing through the interstices of the net-like sheet. The resulting pattern may thereafter be colored.

The present invention has the following objects:

(1) to provide a kit and methods for using the kit to transfer a mural in successive stages to a selected surface, and to allow the coloring of each stage before the next stage is applied;

(2) to provide such kits in forms which allow the rearrangement or insertion of additional elements in the design at the artist's discretion;

(3) to provide such kits in forms which enable the mural patterns to be applied to a flat surface, removed, then reapplied to the same surface in exactly the same position as originally attached, producing images appearing to have depth;

(4) to provide mural kits in forms to allow the overlapping of painted areas, as with conventional paintings to create a three-dimensional effect;

(5) to provide mural kits in forms to allow the artist to select the colors to be applied and guides the artist in applying various shadings of those colors; and (6) to provide such kits in forms which are simple, complete, inexpensive and easy to use.

BRIEF DESCRIPTION OF THE DRAWINGS

These and further objects of the present invention will become more apparent upon consideration of the accompanying drawings, wherein.

DETAILED DESCRIPTION OF THE DRAWINGS

Figure 1:
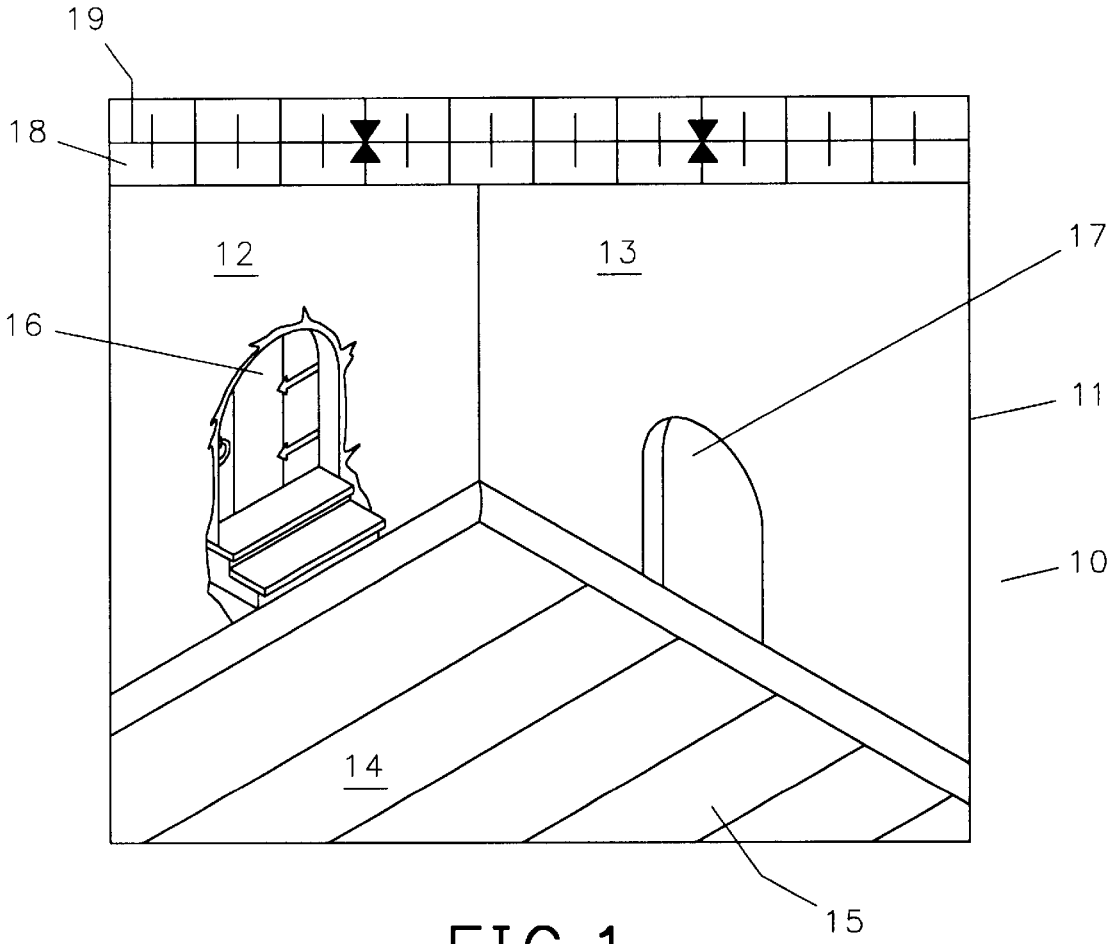
FIG. 1 is an elevation showing a mural pattern positioned on a flat surface together with an aligning strip used to position the mural pattern.

Referring now to FIG. 1, the numeral 10 indicates generally a planar graphics transfer sheet. For purposes of illustration only, transfer sheet 10 is described as a mural transfer sheet intended to allow the graphic elements included on the sheet to be transferred, in stages, to a flat wall surface and thereafter colored or painted to produce a mural. The scene painted in FIG. 1 is a whimsical, cartoonlike scene, although use of the present invention is not limited to such scenes, but may be applied to scenes of more realistic or geometric graphic depictions as well.

The transfer sheet 10 shown in FIG. 1 comprises a background scene 11 consisting of a pair of intersecting walls 12, 13, and a floor 14. As illustrated, the basic elements shown in the background sheet may be highly detailed, such as the inclusion of floor boards 15 on the floor surface 14, and "mouse holes" 16 and 17 shown, respectively, on walls 12 and 13.

Transfer sheet 10 is a type of tracing paper that has a treated graphite-like backing that does not dislodge during ordinary handling. The tracing paper has a front face upon which the design to be transferred is printed and a reverse or back side on which a layer of transfer medium is applied. When sufficient pressure is applied to the front face of the tracing paper by a transfer tool such as a stylus, pinwheel or the like, the portion of the backing directly under the tool is transferred to the surface against which the pressure is exerted, forming a line that replicates the path taken by the tool. The function and operation of the tracing paper will be more fully described hereinbelow.

Figure 2:
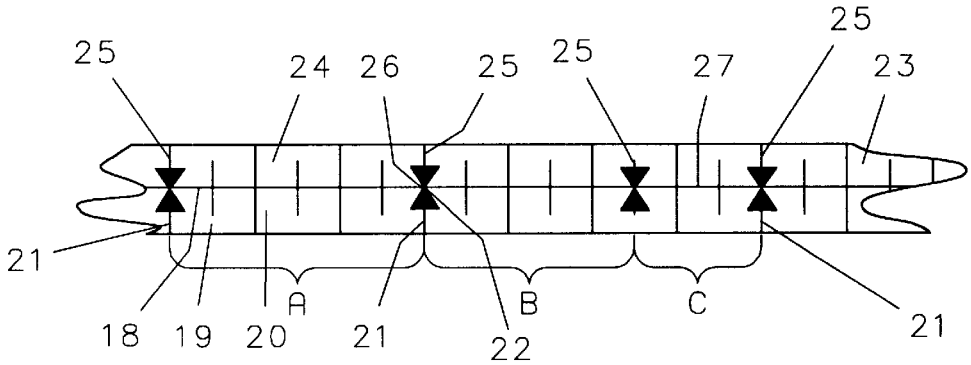
FIG. 2 is a detail showing the mating of the alignment strip and a ruled strip along one edge of the mural pattern of FIG. 1.

As seen in FIG. 1, transfer sheet 10 has an alignment scale 18 printed along its uppermost edge 19. As seen in more detail in FIG. 2, alignment scale 18 is marked off in quarter-inch scale segments 20 with a series of arrows 21 positioned perpendicular to edge 19 and with the point 22 of each arrow 21 touching edge 19. FIG. 2 also shows that arrows 21 are not spaced apart at equal intervals but are spaced with adjacent arrows being separated in a sequence of varying intervals in a reproducible pattern, illustrated herein by the intervals A, B and C shown in FIG. 2.

As further seen in FIG. 2, an alignment guide 23 is provided with identical scale segments 24 and with arrows 25 and arrowheads 26 aligned perpendicular to edge 27 in a pattern matching that of the arrows 21 and arrowheads 22 on alignment scale 18. As will be explained in further detail hereinbelow, alignment guide 23 is used together with alignment scale 18 to allow transfer sheet 10 to be removed from the wall surface and reapplied to the wall surface at exactly the same position.

Figure 3:
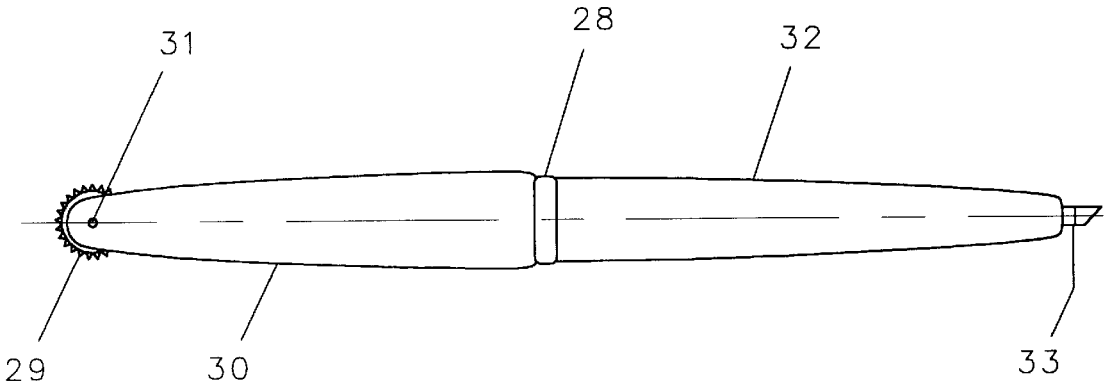
FIG. 3 is an elevation of a transfer wand with both a stylus and a star wheel on the same tool.
Figure 5:
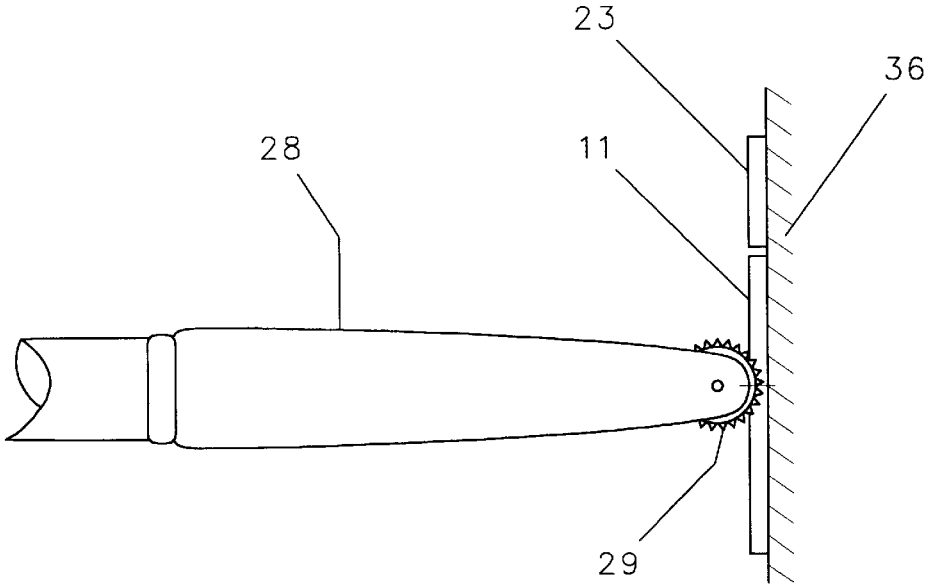
FIG. 5 is a partial side sectional view showing the use of the star wheel to transfer a portion of the mural pattern from the tracing paper to the flat surface to be decorated.

Referring now to FIG. 3, numeral 28 indicates generally a transfer wand used in conjunction with transfer sheet 10 in transferring the graphics on sheet 11 to the surface to be decorated. A blunt toothed tracing wheel, or "pinwheel" 29 is rotatably mounted to a cap 30 on pinwheel axis 31. Wand 28 also includes a barrel 32 to which cap 30 is attached. Barrel 32 has at the lowermost end thereof a stylus 33 which may also be used to trace the design outlines on transfer sheet 10. Use of pinwheel 29 to press upon sheet 11 and transfer designs thereon to wall surface 36 is illustrated in FIG. 5. Pinwheel 29 produces a dashed-line effect, while stylus 33 produces either a thick, solidly shaded or thin solid-line effect depending upon which surface of stylus 33 is brought to bear against transfer sheet 10.

Figure 4:
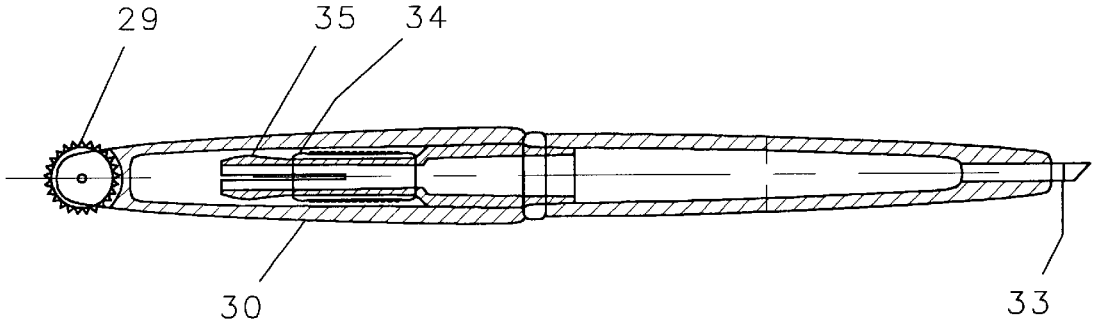
FIG. 4 is a sectional view of the wand shown in FIG. 3.

As seen in FIG. 4, cap 30 may be removed from barrel 32 to expose barrel end 34 into which an eraser assembly 35 is affixed. Should the tracing produced by using either pinwheel 29 or stylus 33 not be satisfactory, eraser 35 may be used to remove the incorrect lines which may thereafter be redrawn.

Use of the present invention may now be described. As seen in FIGS. 1 and 5, alignment guide 23 is first affixed to a surface (in this example, a wall 36) to mark the location at which the mural is to be drawn and painted. Alignment guide 23 is preferably attached to wall 36 with low tack tape, such as masking tape, and a conventional carpenter's level may be used to assure that alignment guide 23 is perfectly horizontal when attached to wall 36. Next, transfer sheet 10 is positioned on wall 36 with alignment scale 18 matched to alignment guide 23. Preferably, alignment guide 23 is matched to alignment scale 18 to match arrowheads 22 and 26 in a series of "bow tie" configurations. Because arrows 21 and 25 are spaced at irregular intervals, matching arrowheads 22 and 26 assures that alignment scale 18 will automatically be lined up with alignment guide 23 in exactly the same relative position each time transfer sheet 10 is removed from and reapplied to wall 36 without having to refer to or remember the numbers along scale 18 or guide 23.

As with alignment guide 23, transfer sheet 10 is attached to wall 36 using low tack masking tape.

Selected elements appearing on transfer sheet 10 are next transferred to wall 36 through use of wand 28. Depending upon the nature of the object being transferred, either pinwheel 29 or stylus 33 is used to trace along individual objects on the transfer sheet 10 to transfer the outline of each such object to wall 36. It is contemplated that successive applications of objects may be transferred to wall 36, painted, and then other, succeeding, objects may be transferred. For example, a user may choose to draw lines delineating walls 12 and 13, and floor 14 and then remove transfer sheet 10, allowing the user to then paint walls 12 and 13 and floor 14. When this first layer of paint has dried, transfer sheet 10 is repositioned on wall 36 by realigning arrowheads 22 and 26 and reattaching transfer sheet 10 to wall 36. Thereafter, the portion of the pattern with additional fine details or foreground and middle ground elements is then added, such as details of floor 15 and mouse holes 16 and 17. Transfer sheet 10 is then removed to allow these additional elements to be painted.

In this manner, successive layers of details may be added calling for either different brushes, different colors, or individual artistic effort to personalize the appearance of the mural.

Figure 6:
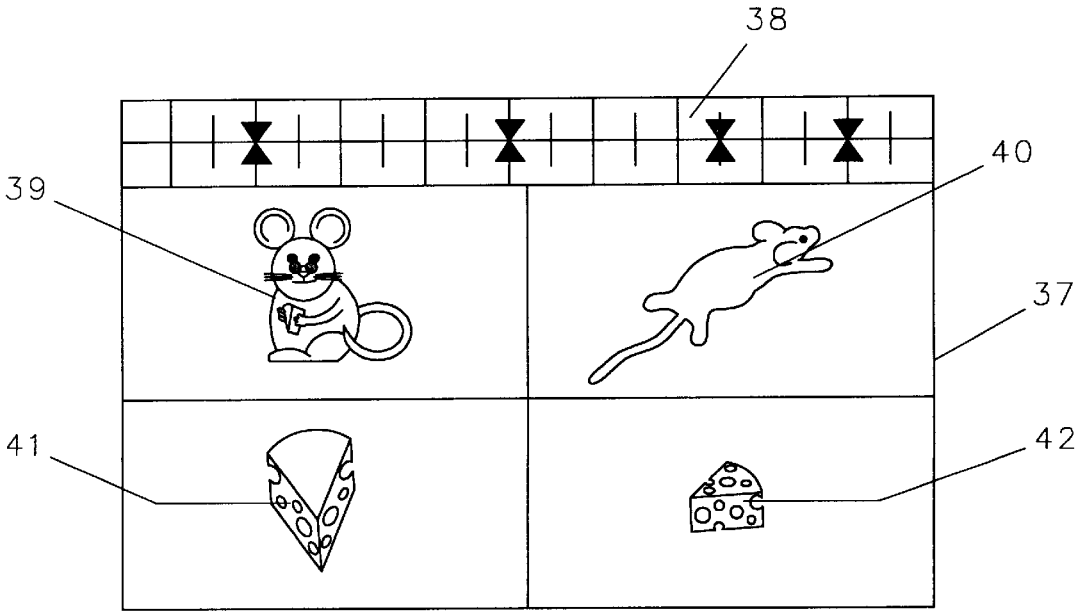
FIG. 6 is an elevation of a second mural pattern sheet showing individual mural elements which may be positioned on the mural after the background mural elements have been completed.

Referring now to FIG. 6, an object sheet 37 is provided, manufactured from the same type of tracing paper as is used for transfer sheet 10. Object sheet 37 has attached to its uppermost edge an object sheet alignment scale 38 identical in scale or construction to alignment scales 18 and 23.

As seen in FIG. 6, object sheet 37 has a number of individual mural objects drawn thereon. In the example selected, these objects consist of a first mouse 39, a second mouse 40, a first piece of cheese 41 and a second piece of cheese 42. As can readily be appreciated, any number of different objects may also be included. For example, a door drawn to fit either mouse hole 16 or 17 may be included. Other objects may also be included that would be consistent with the theme of the mural. To position an object from object sheet 37 on the mural as it appears on wall 36, object sheet alignment scale 38 is aligned with alignment guide 23. To protect the already-painted mural elements, object sheet 37 is secured to wall 36 through use of low tack tape, and wand 28 is used to effect transfer of the object to wall 36. It is also contemplated that the dimensions of object sheet 37 are selected to allow sheet 37 to be taped to wall 36 at points which do not touch previously painted portions of the wall in order to protect the work already performed. For example, object sheet 37 can be much larger than the anticipated finished size of the mural so that the borders of object sheet 37 extend past the already-painted portions and can be taped to wall 36 where no mural elements appear.

The user is free to select the type and color of paints to be used for the mural elements. Each transfer sheet 10 includes on each area of the sheet a corresponding number, letter or number/letter combination to assist the user in appropriately coloring that portion of the mural. A guide sheet showing outlines of each of the objects may also be provided with numbers to direct the user to apply recommended colors in certain locations and to assist the user in shading as well.

Figure 7:
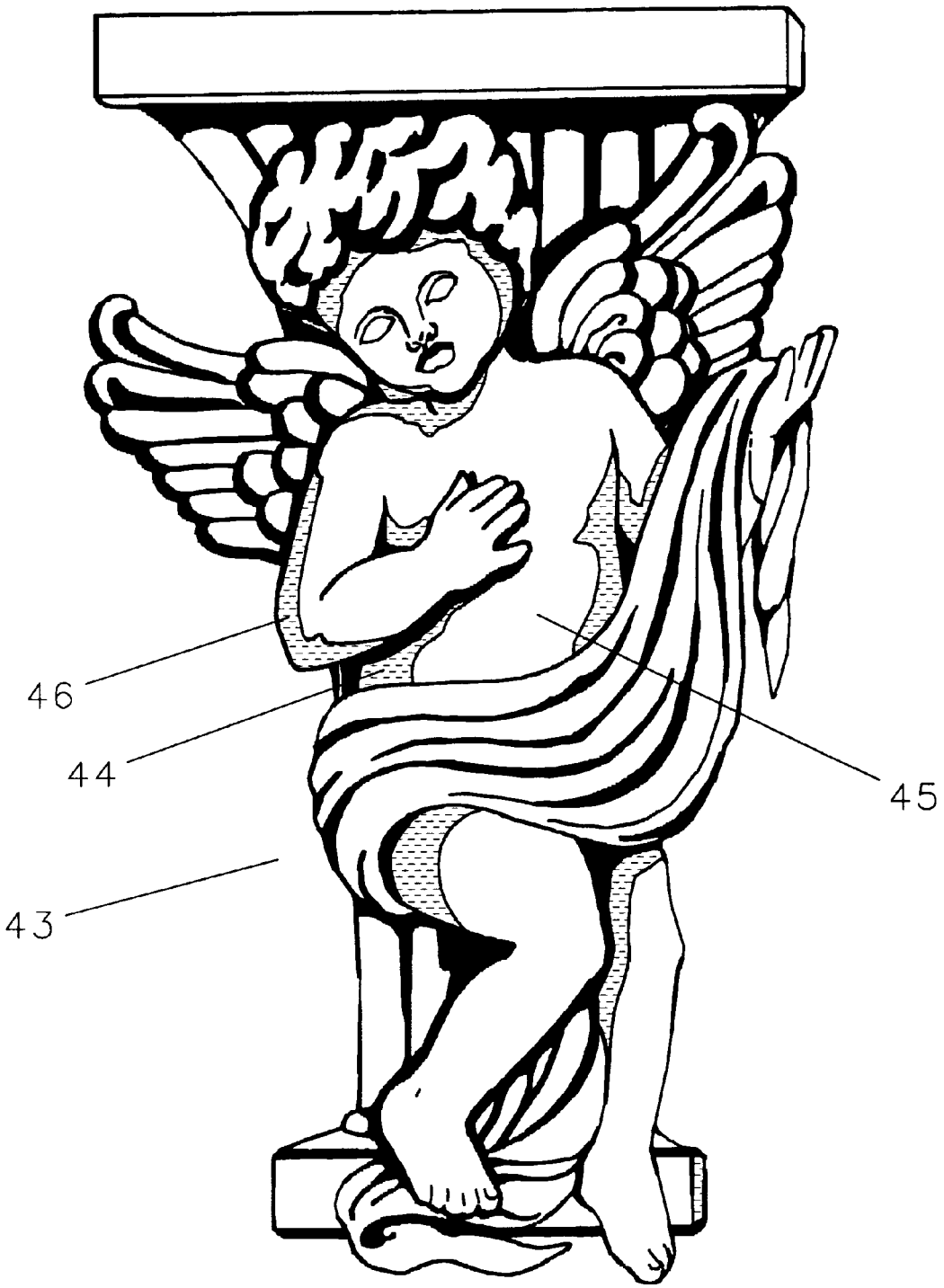
FIG. 7 is a mural element pattern showing the provision of shading strips.

As seen in FIG. 7, certain of the graphics on transfer sheet 11 are coded to guide a user to create artistic effects by using various shades of a selected color. As an example, the cherub 43 shown in FIG. 7 is outlined with first shade areas 44, second shade areas 45 and third shade areas 46. In this example, each shade area corresponds with a shade of gray taken ranging from dark gray (44), medium gray (45) and light gray (46). By following the shading suggestions, a user can create three-dimensional effects not heretofore possible with paint-by-number kits or other kits that produce graphics marked only in discrete color areas. Graphics furnished with the present invention will suggest color schemes and combinations and will have certain elements marked with codes that indicate "dark", "normal" and "light" shades of whatever color is selected. For example, light pink areas may be labelled as "P1", unshaded or medium pink areas as "P2" and dark pink areas as "P3". A coding system can be used throughout such that the numerical suffix will consistently indicate a relative shade of color, such as "1" for light, "2" for medium and "3" for dark. While the preferred colors are suggested on transfer sheet 10, the user may substitute other colors while still retaining the relative shading technique. For example, if a rose illustration is shown which suggests the use of light, medium and dark reds, the user may substitute yellow for red, using light, medium and dark shades of yellow. Stylus 33 of wand 28 can be used to trace shading areas as solidly filled areas to make these areas apparent after transfer sheet 10 has been removed.

The foregoing example has described a mural having a central theme and objects to be inserted on the graphic created by painting and completing transfer sheet 10, and has also described the use of an additional object sheet 37 on which additional objects are printed. Use of object sheet 37 has been described in connection with object sheet alignment scale 38 in the same manner as transfer sheet 10.

However, the invention is not be limited by this description. It should be readily apparent that additional objects from object sheet 37 can also be positioned on transfer sheet 10 by cutting a selected object from sheet 37 and taping it to transfer sheet 10. It should also be readily apparent that the graphics supplied with the kit can be printed on ordinary paper and thereafter taped to transfer sheet 10 or to a sheet of transfer paper that has no graphics thereon but which has an alignment scale 23 thereon. Other graphics may also be included from a more general or "clip art" collection of objects, and a user may choose to create his or her own artwork, or procure a piece of artwork independently of the kit and affix the artwork to transfer sheet 10 or to a sheet of tracing paper having an alignment scale 18. In this fashion, a completely personalized piece of art may be created.

The foregoing has described the surface to which decorations are to be applied as a wall surface. Any surface may be so employed, including such surfaces as drawer fronts, S cabinet fronts and tops, trunks, suitcases, and the like. It is also contemplated that transfer sheets with backings of different colors may be used where, for example, a background color is fairly dark requiring the use of a lighter transfer ink to produce a visible pattern. For example, a white Berol™ color stick may be rubbed on the back of a transfer sheet so that successive transfers using that sheet will appear as white lines instead of dark lines. Additionally, the patterns may be reused by applying graphite to the areas on the back of the transfer sheet where the dark coating has previously been transferred.

It is contemplated that the foregoing apparatus will be provided in the form of a kit which will include transfer sheets, object sheets, a wand or stylus and alignment guides and other material needed to apply and complete the graphics, such as color symbol keys, shading instructions and tracing and painting tips.

While the foregoing has presented a preferred embodiment of the present invention, it is important to understand that this embodiment has been presented by way of example only and is not intended to limit the spirit or scope of the invention claimed and described. It is contemplated that others skilled in the art will perceive differences which, while varying from the foregoing, do not depart from the spirit and scope of the invention as claimed and described.

What is claimed is:

1. A method of applying graphics to a rigid substantially planar surface, said graphics comprised of selected graphic elements, said method comprising the steps of:

(a) positioning said graphic elements on a first side of a sheet of paper having a transfer medium applied to a second side thereof to form a transfer sheet;

(b) positioning said transfer sheet on said surface at a chosen position;

(c) transferring an outline of basic shapes of said graphic elements from said first side of said transfer sheet to said surface by rubbing the outline of at least one of such basic shapes of said graphic element onto said surface to apply said transfer medium from said second side to said surface;

(d) removing said transfer sheet from said surface;

(e) painting or otherwise coloring said basic shapes of said selected elements on said surface;

(f) repositioning said transfer sheet on said surface at said chosen position, and (g) transferring detail lines within said graphic elements from said first side of said transfer sheet to said surface by rubbing over said detail lines thereof to apply transfer medium to said surface.

2. The method of claim 1 and after step (g) thereof further comprising the steps of:

removing said transfer sheet from said surface, and painting or otherwise coloring or shading within areas defined by said detail lines.

3. The method of claim 1 and further comprising the step of, providing means for repositioning said transfer sheet on said surface at said chosen position.

4. The method of claim 1 wherein said means for repositioning is applied only to said first side of said transfer sheet and to said surface.

5. A method for creating a graphic composition on a receiving surface, said method comprising the steps of:

providing transfer sheets having front and rear surfaces thereon;

affixing to one of said transfer sheet surfaces a graphic display having a composition outline, said composition outline being viewable at said front surface of said sheet;

affixing to one of said transfer sheet surfaces a graphic display having details to be positioned relative to said composition outline, said details being viewable at said front surface of said sheet;

affixing means on said rear surface of said transfer sheet having said graphic display having a composition outline thereon for transferring said composition outline to said receiving surface;

affixing means on said rear surface of said transfer sheet having said graphic display having details thereon for transferring said details to said receiving surface, positioning said transfer sheet on said receiving surface, applying pressure on said front surface of said transfer sheet over said outline to transfer said outline to said receiving surface, removing said transfer sheet from said receiving surface, painting or otherwise coloring or shading an area generally inside said outline on said receiving surface, positioning said transfer sheet on the painted or otherwise colored or shaded area on said receiving surface, applying pressure on said top surface of said transfer sheet over at-least selected portions of said details to transfer a graphic display of details relative to said painted or otherwise colored or shaded area on said receiving surface.

6. The method as called for in claim 5 further including the step of, painting or otherwise coloring or shading an area defined by said details.

7. A method for creating a graphic composition on a receiving surface, said method comprising the steps of:

positioning an outline transfer sheet on a receiving surface, said transfer sheet having graphic display viewable from a front surface of said sheet, said graphic display including at least a composition outline thereon, rubbing a front surface of said outline transfer sheet over said composition outline to transfer said outline to said receiving surface, removing said outline transfer sheet from said receiving surface, painting or otherwise coloring or shading an area generally inside said outline on said receiving surface, positioning a details transfer sheet on the painted or otherwise colored or shaded area on said receiving surface, said transfer sheet having a graphic display viewable at a front surface of said sheet, said graphic display including details thereon, rubbing said front surface of said details transfer sheet over at least selected portions of said details to transfer a graphic display of details relative to said painted or otherwise colored or shaded area on said receiving surface.

8. The method as called for in claim 7 further including the step of, painting or otherwise coloring or shading an area defined by said details.

9. The method as called for in claim 7 wherein said step of positioning said outline transfer sheet and the step of positioning said details transfer sheet include the step of positioning a single sheet having both an outline and details viewable from a front surface thereof.

* * * * *